US010916173B2

(12) United States Patent
Dai et al.

(10) Patent No.: US 10,916,173 B2
(45) Date of Patent: Feb. 9, 2021

(54) METHOD AND APPARATUS FOR CONVERTING GRAYSCALE, AND DISPLAY DEVICE

(71) Applicant: BOE Technology Group Co., Ltd., Beijing (CN)

(72) Inventors: Bin Dai, Beijing (CN); Yanhui Xi, Beijing (CN); Xiaomang Zhang, Beijing (CN); Yan Sun, Beijing (CN); Yue Li, Beijing (CN); Yuxin Bi, Beijing (CN); Yankai Gao, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/397,185

(22) Filed: Apr. 29, 2019

(65) Prior Publication Data

US 2020/0043396 A1 Feb. 6, 2020

(30) Foreign Application Priority Data

Jul. 31, 2018 (CN) ..... 2018 1 0857316

(51) Int. Cl.
*G09G 3/36* (2006.01)
*G09G 3/20* (2006.01)

(52) U.S. Cl.
CPC ..... *G09G 3/2003* (2013.01); *G09G 3/3607* (2013.01)

(58) Field of Classification Search
CPC ... G09G 3/2003; G09G 3/3607; G09G 3/2007
See application file for complete search history.

(56) References Cited

U.S. PATENT DOCUMENTS

| | | | | |
|---|---|---|---|---|
| 9,570,015 | B2 * | 2/2017 | Yang | G09G 3/2003 |
| 2005/0285828 | A1 * | 12/2005 | Inoue | G09G 3/3208 345/76 |
| 2008/0272701 | A1 * | 11/2008 | Park | G09G 3/3413 315/151 |
| 2009/0102769 | A1 * | 4/2009 | Kouno | G09G 3/3648 345/88 |
| 2009/0160747 | A1 * | 6/2009 | Morisue | G09G 3/3406 345/88 |
| 2015/0054864 | A1 * | 2/2015 | Choi | G09G 3/006 345/694 |
| 2015/0187303 | A1 * | 7/2015 | Choi | G09G 3/20 345/691 |

(Continued)

*Primary Examiner* — Carolyn R Edwards
(74) *Attorney, Agent, or Firm* — Arent Fox LLP; Michael Fainberg

(57) ABSTRACT

The disclosure relates to a method and apparatus for converting a grayscale, and a display device, where color coordinates of respective pixel elements are determined according to grayscales corresponding to red sub-pixels, green sub-pixels, and blue sub-pixels in the respective pixel elements in image data of a frame to be displayed, and then the distances between the color coordinates of the respective pixel elements, and color coordinates of a preset white pixel on the panel, in a CIE chroma graph are determined; and the maximum grayscales of white sub-pixels in the respective pixel elements are further determined according to the respective determined distances and a preset segmentation function.

10 Claims, 4 Drawing Sheets

(56) References Cited

U.S. PATENT DOCUMENTS

| | | | | |
|---|---|---|---|---|
| 2016/0379594 | A1* | 12/2016 | Cho | G09G 5/04 345/601 |
| 2017/0221404 | A1* | 8/2017 | Park | G09G 3/3406 |
| 2018/0090044 | A1* | 3/2018 | Fan | G09G 3/32 |
| 2019/0172404 | A1* | 6/2019 | Zhu | G09G 3/3607 |
| 2019/0237009 | A1* | 8/2019 | Chu | G09G 3/2003 |
| 2020/0027421 | A1* | 1/2020 | Sun | G09G 5/028 |

* cited by examiner

METHOD AND APPARATUS FOR CONVERTING GRAYSCALE, AND DISPLAY DEVICE

CROSS-REFERENCE TO RELATED APPLICATION

This application claims priority of Chinese Patent Application No. 201810857316.0, filed on Jul. 31, 2018, which is hereby incorporated by reference in its entirety.

FIELD

The present disclosure relates to the field of display technologies, and particularly to a method and apparatus for converting a grayscale, and a display device.

BACKGROUND

As the display technologies are advancing, there is a demand of consumers for a display panel with a higher quality. In order to improve the brightness of the display panel, the display panel can include a plurality of pixel elements PX, each of which includes a red sub-pixel R, a green sub-pixel G, a blue sub-pixel B, and a white sub-pixel W, as illustrated in FIG. 1, so that the white color is added to the display panel including the exist three primary colors of red, green, and blue to thereby improve the brightness of the display panel. Particularly in an outdoor mode, when the brightness of natural light is very high, the brightness of the display panel can be improved for a user to watch the display panel conveniently.

SUMMARY

Some embodiments of the disclosure provide a method for converting a grayscale, the method including:

receiving image data of a frame to be displayed, wherein the image data of the frame to be displayed include grayscales corresponding respectively to red sub-pixels, green sub-pixels, and blue sub-pixels in respective pixel elements;

determining color coordinates of the respective pixel elements according to the grayscales corresponding to the red sub-pixels, the green sub-pixels, and the blue sub-pixels in the respective pixel elements;

determining distances between the color coordinates of the respective pixel elements, and color coordinates of a preset white pixel on the panel, in a CIE chroma graph; and determining a maximum grayscale of the white sub-pixels in the respective pixel elements according to the respective determined distances and a preset segmentation function.

Optionally, in some embodiments of the disclosure, the determining the maximum grayscale of the white sub-pixels in the respective pixel elements according to the respective determined distances and the preset segmentation function includes:

for each pixel element, determining the maximum grayscale $W_{pixel_max}$ of the white sub-pixel in the pixel element in the equation of:

$$W_{pixel_max} = f(k) * W_{max}, \text{ and}$$

$$f(k) = \begin{cases} \alpha_0 + \alpha_1 k + \alpha_2 k^2 + \alpha_3 k^3 + \ldots + \alpha_n k^n & (0 \le k \le k_1) \\ \beta_0 + \beta_1 k + \beta_2 k^2 + \beta_3 k^3 + \ldots + \beta_m k^m & (k_1 < k \le 1) \end{cases},$$

wherein k represents the distance between the color coordinates of the pixel element, and the color coordinates of the preset white pixel on the panel, in the CIE chroma graph, $W_{max}$ represents the maximum of all the normalized grayscales in the image data of the frame to be displayed, $\alpha_n$ and $\beta_m$ represents coefficients respectively, $n \ge 0$ and n is an integer, $m \ge 0$ and m is an integer, and $0 \le k_1 \le 1$.

Optionally, in some embodiments of the disclosure, $k_1=0.5$, n=3, and m=2.

Optionally, in some embodiments of the disclosure, the determining the color coordinates of the respective pixel elements according to the grayscales corresponding to the red sub-pixels, the green sub-pixels, and the blue sub-pixels in the respective pixel elements includes:

for each pixel element, determining a simulation value X corresponding to the red sub-pixel, a simulation value Y corresponding to the green sub-pixel, and a simulation value Z corresponding to the blue sub-pixel in the pixel element in the equation of:

$$\begin{pmatrix} X \\ Y \\ Z \end{pmatrix} = \begin{pmatrix} X_R & X_G & X_B \\ Y_R & Y_G & Y_B \\ Z_R & Y_G & Z_B \end{pmatrix} * \begin{pmatrix} R \\ G \\ B \end{pmatrix},$$

wherein $$\begin{pmatrix} X_R & X_G & X_B \\ Y_R & Y_G & Y_B \\ Z_R & Y_G & Z_B \end{pmatrix}$$

represents coefficients, R represents the grayscale of the red sub-pixel in the pixel element, G represents the grayscale of the green sub-pixel in the pixel element, and B represents the grayscale of the blue sub-pixel in the pixel element; and determining the color coordinates (x, y) of the pixel element according to the determined simulation value X corresponding to the red sub-pixel, simulation value Y corresponding to the green sub-pixel, and the simulation value Z corresponding to the blue sub-pixel in the equation of:

$$\begin{cases} x = \dfrac{X}{X+Y+Z} \\ y = \dfrac{Y}{X+Y+Z} \end{cases}.$$

Correspondingly, some embodiments of the disclosure provides an apparatus for converting a grayscale, the apparatus including:

a receiving module configured to receive image data of a frame to be displayed, wherein the image data of the frame to be displayed can include grayscales corresponding respectively to red sub-pixels, green sub-pixels, and blue sub-pixels in respective pixel elements;

a color coordinate determining module configured to determine color coordinates of the respective pixel elements according to the grayscales corresponding to the red sub-pixels, the green sub-pixels, and the blue sub-pixels in the respective pixel elements;

a distance determining module configured to determine distances between the color coordinates of the respective pixel elements, and color coordinates of a preset white pixel on the panel, in a CIE chroma graph; and a grayscale determining module configured to determine a maximum grayscale of the white sub-pixels in the respective pixel elements according to the respective determined distances and a preset segmentation function.

Optionally, in some embodiments of the disclosure, the grayscale determining module is configured, for each pixel element, to determine the maximum grayscale $W_{pixel_max}$ of the white sub-pixel in the pixel element in the equation of:

$$W_{pixel_max} = f(k) * W_{max}, \text{ and}$$

$$f(k) = \begin{cases} \alpha_0 + \alpha_1 k + \alpha_2 k^2 + \alpha_3 k^3 + \ldots + \alpha_n k^n & (0 \le k \le k_1) \\ \beta_0 + \beta_1 k + \beta_2 k^2 + \beta_3 k^3 + \ldots + \beta_m k^m & (k_1 < k \le 1) \end{cases},$$

wherein k represents the distance between the color coordinates of the pixel element, and the color coordinates of the preset white pixel on the panel, in the CIE chroma graph, $W_{max}$ represents the maximum of all the normalized grayscales in the image data of the frame to be displayed, $\alpha_n$ and $\beta_m$ represents coefficients respectively, $n \ge 0$ and n is an integer, $m \ge 0$ and m is an integer, and, $0 \le k_1 \le 1$.

Optionally, in the embodiment of the disclosure, $k_1=0.5$, $n=3$, and $m=2$.

Optionally, in the embodiment of the disclosure, the color coordinate determining module is configured, for each pixel element, to determine a simulation value X corresponding to the red sub-pixel, a simulation value Y corresponding to the green sub-pixel, and a simulation value Z corresponding to the blue sub-pixel in the pixel element in the equation of:

$$\begin{pmatrix} X \\ Y \\ Z \end{pmatrix} = \begin{pmatrix} X_R & X_G & X_B \\ Y_R & Y_G & Y_B \\ Z_R & Y_G & Z_B \end{pmatrix} * \begin{pmatrix} R \\ G \\ B \end{pmatrix},$$

wherein $$\begin{pmatrix} X_R & X_G & X_B \\ Y_R & Y_G & Y_B \\ Z_R & Y_G & Z_B \end{pmatrix}$$

represents coefficients, R represents the grayscale of the red sub-pixel in the pixel element, G represents the grayscale of the green sub-pixel in the pixel element, and B represents the grayscale of the blue sub-pixel in the pixel element; and to determine the color coordinates (x, y) of the pixel element according to the determined simulation value X corresponding to the red sub-pixel, simulation value Y corresponding to the green sub-pixel, and the simulation value Z corresponding to the blue sub-pixel in the equation of:

$$\begin{cases} x = \dfrac{X}{X+Y+Z} \\ y = \dfrac{Y}{X+Y+Z} \end{cases}.$$

Correspondingly, some embodiments of the disclosure provide a display device including the apparatus above for converting a grayscale.

Optionally, in some embodiments of the disclosure, the display device further includes a display panel and a display driver, wherein the display panel includes a plurality of pixel elements PX, each of which includes a red sub-pixel R, a green sub-pixel G, a blue sub-pixel B, and a white sub-pixel W; and the display driver is configured to drive the display panel to display an image, according to the maximum grayscales of the white sub-pixels in the respective pixel elements, and the grayscales corresponding to the red sub-pixels, the green sub-pixels, and the blue sub-pixels in the respective pixel elements, determined by the apparatus for converting a grayscale.

DETAILED DESCRIPTION OF THE EMBODIMENTS

Figure 1:
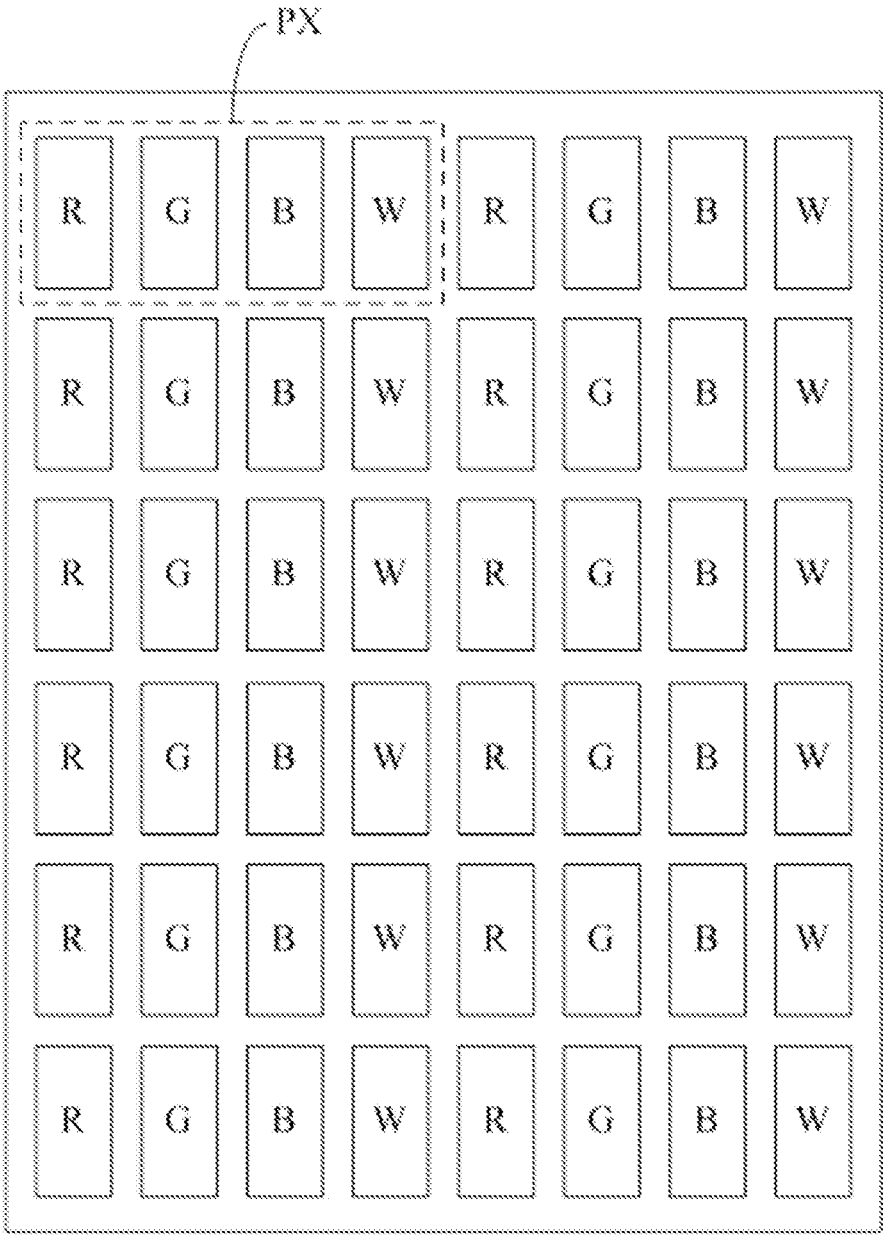
FIG. 1 is a schematic structural diagram of a display panel in the related art.
Figure 2:
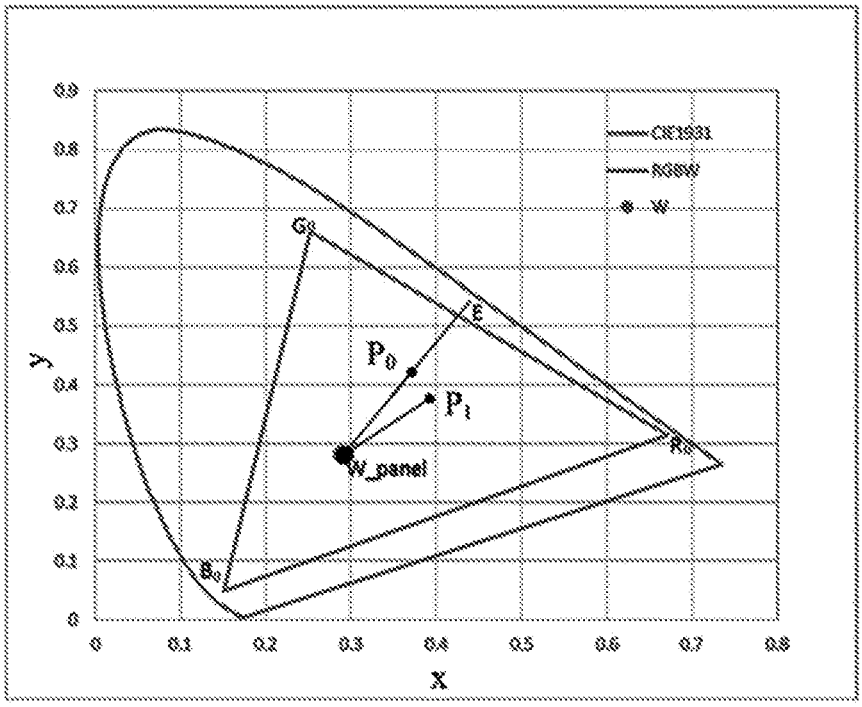
FIG. 2 is a schematic diagram of a CIE chroma graph in the related art.

At present, a method for converting a grayscale in the display panel as illustrated in FIG. 1 can include the following steps:

the step S01 is to receive image data of a frame to be displayed, where the image data of the frame to be displayed can include grayscales corresponding respectively to red sub-pixels, green sub-pixels, and blue sub-pixels in respective pixel elements;

the step S02 is, for each pixel element, to determine color coordinates of the pixel element according to the grayscales corresponding to the red sub-pixel, the green sub-pixel, and the blue sub-pixel in the pixel element; and the step S03 is, for each pixel element, to determine the maximum grayscale $W_{pixel_max}$ of the white sub-pixel in the pixel element in the equation of:

$$W_{pixel_max} = \left(1 - \frac{L_{PW_{panel}}}{L_{EW_{panel}}}\right) * W_{max};$$

where $W_{max}$ represents the maximum of all the normalized grayscales in the image data of the frame to be displayed, $L_{PW_{panel}}$ represents the distance between the color coordinates of the pixel element and color coordinates of a preset white pixel on the panel, in a CIE chroma graph, and $L_{EW_{panel}}$ represents the distance between color coordinates of an intersection of a straight line passing the color coordinates of the pixel element, and the color coordinates of the preset white pixel on the panel, and a straight line passing color coordinates in the primary colors of red and green, and the color coordinates of the preset white pixel on the panel, in the CIE chroma graph. Optionally, the CIE chroma graph is the 1931 CIE chroma graph. As illustrated in FIG. 2, $P_0$ represents the corresponding position of the color coordinates of the pixel element in the CIE chroma graph, $W_{panel}$ represents the corresponding position of the color coordinates of the preset white pixel on the panel in the CIE chroma graph, $R_0$, $G_0$, and $B_0$ represent the positions of the color coordinates in the three primary colors of red, green, and blue respectively in the CIE chroma graph, and E represents the intersection of the straight line passing the color coordinates of the element, and the color coordinates of the preset white pixel on the panel (i.e., a straight line passing $P_0$ and $W_{panel}$), and the straight line passing the color coordinates in the primary colors of red and green (i.e., a straight line passing $R_0$ and $G_0$), so $L_{PW_{panel}}$ represents the distance between $P_0$ and $W_{panel}$ in the CIE chroma graph, and $L_{EW_{panel}}$ represents the distance between E and $W_{panel}$ in the CIE chroma graph, where the color coordinates of the preset white pixel on the panel are an inherent attribute of the display panel. When the display panel is a liquid crystal display panel, color coordinates of light exiting a color filter layer illuminated by a backlight source can be set as the color coordinates of the preset white pixel on the panel. In a real application, the color coordinates of the preset white pixel on the panel can be regarded as color coordinates of a D65 standard light source at color temperature of 6500K±200K.

Figure 3:
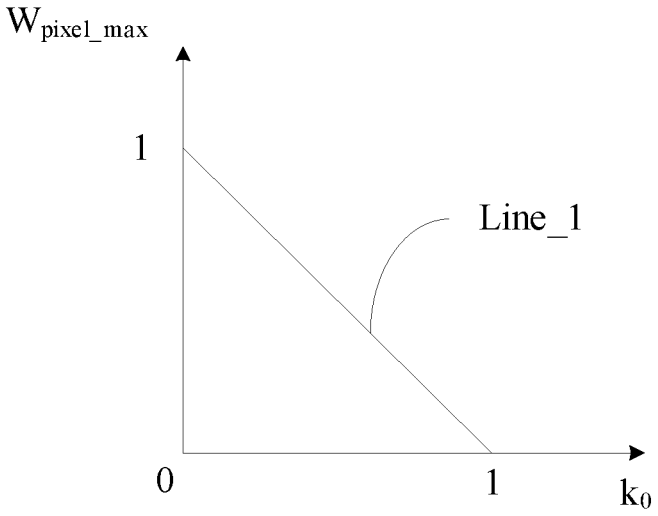
FIG. 3 is a schematic diagram of a function of $k_0$ in the related art.

With $$k_0 = 1 - \frac{L_{PW_{panel}}}{L_{EW_{panel}}},$$

there is a linear function of $$k_0 = 1 - \frac{L_{PW_{panel}}}{L_{EW_{panel}}}$$

represented as Line_1 in FIG. 3. As can be apparent from FIG. 3, the value of $L_{EW_{panel}}$ is fixed, and as $L_{EW_{panel}}$ is smaller, that is, as the distance between $P_0$ and $W_{panel}$ in the CIE chroma graph is shorter, $k_0$ is larger, and thus the value of $W_{pixel_max}$ is larger, so that the brightness in an area with higher brightness in the image is greatly improved; otherwise, $k_0$ is smaller, and thus the value of $W_{pixel_max}$ is smaller, so that $k_0$ corresponding to an area with lower brightness in the image is smaller, so the brightness in the with lower brightness is hardly improved, thus hindering the image from being rendered in color, and degrading the display effect.

In view of this, embodiments of the disclosure provide a method and apparatus for converting a grayscale, and a display device so as to improve the display effect.

In order to make the objects, technical solutions, and advantages of the disclosure more apparent, particular implementations of the method and apparatus for converting a grayscale, and the display device according to the embodiments of the disclosure will be described below in details with reference to the drawings. Apparently the preferable embodiments to be described are only intended to illustrate and explain the disclosure, but not intended to limit the disclosure thereto. The embodiments of the disclosure, and the features in the embodiments can be combined with each other unless they conflict with each other. Like or similar reference numerals throughout the drawings will refer to like or similar elements, or elements with like or similar functions.

Some embodiments of the disclosure provide a method for converting a grayscale in the display panel as illustrated in FIG. 1 including a plurality of pixel elements PX, each of which includes a red sub-pixel R, a green sub-pixel G, a blue sub-pixel B, and a white sub-pixel W.

Figure 4:
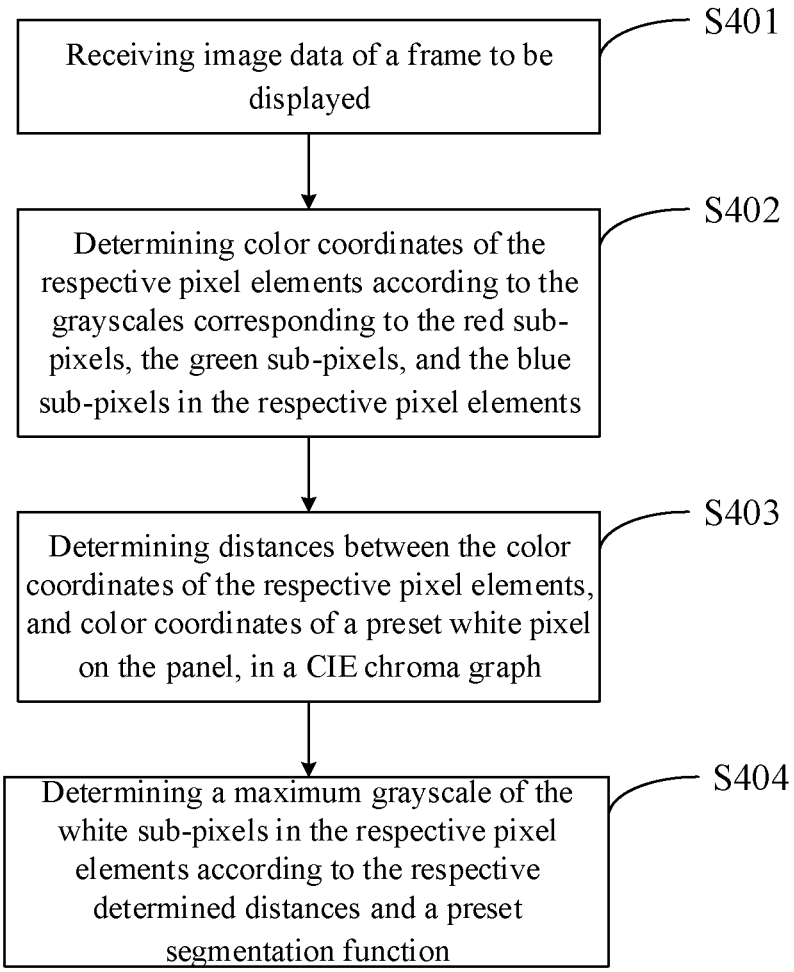
FIG. 4 is a flow chart of a method for converting a grayscale according to some embodiments of the disclosure.

As illustrated in FIG. 4, the method for converting a grayscale according to embodiments of the disclosure can include the following steps.

The step S401 is to receive image data of a frame to be displayed, where the image data of the frame to be displayed can include grayscales corresponding respectively to red sub-pixels, green sub-pixels, and blue sub-pixels in respective pixel elements.

Grayscales are generally divided into a plurality of levels in an interval of varying brightness between the lowest brightness and the highest brightness, that is, the grayscales represent the levels of the different brightness between the lowest brightness and the highest brightness. As the number of levels is growing, then an image will be rendered at a finer granularity. At present, an image is generally displayed on a 6-bit or 8-bit display panel, where $2^8$, i.e., 256, brightness levels can be rendered on the 8-bit display panel, that is, there are 256 grayscales including 0 to 255; and $2^6$, i.e., 64, brightness levels can be rendered on the 6-bit display panel, that is, there are 64 grayscales including 0 to 63.

The step S402 is to determine color coordinates of the respective pixel elements according to the grayscales corresponding to the red sub-pixels, the green sub-pixels, and the blue sub-pixels in the respective pixel elements.

Optionally, for each pixel element, a simulation value X corresponding to the red sub-pixel, a simulation value Y corresponding to the green sub-pixel, and a simulation value Z corresponding to the blue sub-pixel in the pixel element can be determined in the equation of:

$$\begin{pmatrix} X \\ Y \\ Z \end{pmatrix} = \begin{pmatrix} X_R & X_G & X_B \\ Y_R & Y_G & Y_B \\ Z_R & Y_G & Z_B \end{pmatrix} * \begin{pmatrix} R \\ G \\ B \end{pmatrix},$$

where $$\begin{pmatrix} X_R & X_G & X_B \\ Y_R & Y_G & Y_B \\ Z_R & Y_G & Z_B \end{pmatrix}$$

represents coefficients, determined by the characteristic of the display panel, which can be measured using an instrument (e.g., the CA310-Color Analyzer) after the display panel is fabricated, R represents the grayscale of the red sub-pixel in the pixel element, G represents the grayscale of the green sub-pixel in the pixel element, and B represents the grayscale of the blue sub-pixel in the pixel element, so that the simulation value X corresponding to the red sub-pixel, the simulation value Y corresponding to the green sub-pixel, and the simulation value Z corresponding to the blue sub-pixel in each pixel element can be determined in the equation above.

The color coordinates (x, y) of the pixel element is determined according to the determined simulation value X corresponding to the red sub-pixel, simulation value Y corresponding to the green sub-pixel, and the simulation value Z corresponding to the blue sub-pixel can be determined in the equation of:

$$\begin{cases} x = \dfrac{X}{X+Y+Z} \\ y = \dfrac{Y}{X+Y+Z} \end{cases}$$

The step S403 is to determine the distances between the color coordinates of the respective pixel elements, and color coordinates of a preset white pixel on the panel, in a CIE chroma graph. As illustrated in FIG. 2, $P_1$ represents the corresponding position of color coordinates (x, y) of a pixel element in the CIE chroma graph, so the distance between the chroma coordinates of the pixel element, and the color coordinates of the preset white pixel on the panel, in the CIE chroma graph is the distance between $P_1$ and $W_{panel}$.

The step S404 is to determine the maximum grayscales of the white sub-pixels in the respective pixel elements according to the respective determined distances and a preset segmentation function.

Figure 5:
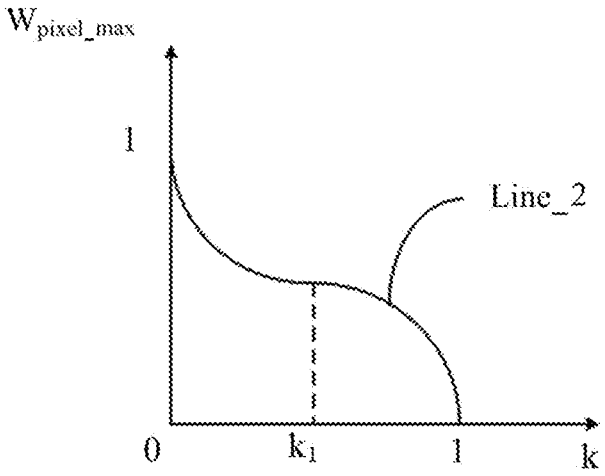
FIG. 5 is a schematic diagram of a function of k according to some embodiments of the disclosure.

For each pixel element, the maximum grayscale of the white sub-pixel in the pixel element can be determined in the equation of:

$$W_{pixel_max} = f(k) * W_{max}, \text{ and}$$

$$f(k) = \begin{cases} \alpha_0 + \alpha_1 k + \alpha_2 k^2 + \alpha_3 k^3 + \ldots + \alpha_n k^n & (0 \le k \le k_1) \\ \beta_0 + \beta_1 k + \beta_2 k^2 + \beta_3 k^3 + \ldots + \beta_m k^m & (k_1 < k \le 1) \end{cases},$$

where k represents the distance between the color coordinates of the pixel element, and the color coordinates of the preset white pixel on the panel, in the CIE chroma graph, $W_{max}$ represents the maximum of all the normalized grayscales in the image data of the frame to be displayed, $\alpha_n$ and $\beta_m$ represents coefficients respectively, $n \ge 0$ and n is an integer, $m \ge 0$ and m is an integer, and $0 \le k_1 \le 1$. Taking a 8-bit panel as an example, all the normalized grayscales in the image data of the frame to be displayed refer to all the grayscales in the image data of the frame, which are divided by 255, and then distributed between 0 and 1. In this way, f(k) can be Line_2 as illustrated in FIG. 5, so that as the distance between $P_1$ and $W_{panel}$ is shorter, that is, $P_1$ is closer to $W_{panel}$, the value of $W_{pixel_max}$ is smaller; otherwise, the value of $W_{pixel_max}$ is larger, thus improving the rendition and display effect of an image in color.

Furthermore, in a particular implementation, in some embodiments of the disclosure, $\alpha_n$, $\beta_m$, n, and m can be empirically derived respectively, or can be determined respectively as needed in a real application environment. For example, the really fabricated display panel can be tested so that $k_1=0.5$, $n=3$, $m=2$, $\alpha_1=1$, $\alpha_2=-3.422$, $\alpha_3=8.6209$, $\alpha_4=-7.5536$, $\beta_1=-0.2451$, $\beta_2=2.7085$, $\beta_3=-2.4617$ are derived from test results through fitting, that is, $$f(k) = \begin{cases} 1 - 3.422k + 8.6209k^2 - 7.5536k^3 & (0 \le k \le 0.5) \\ -0.2451 + 2.7085k - 2.4617k^2 & (0.5 < k \le 1) \end{cases},$$

thus providing the best display effect of the display panel.

In the method for converting a grayscale according to some embodiments of the disclosure, the color coordinates of the respective pixel elements are determined according to the grayscales corresponding to the red sub-pixels, the green sub-pixels, and the blue sub-pixels in the respective pixel elements in the image data of the frame to be displayed, and then the distances between the color coordinates of the respective pixel elements, and the color coordinates of the preset white pixel on the panel, in the CIE chroma graph are determined; and the maximum grayscales of the white sub-pixels in the respective pixel elements is further determined according to the respective determined distances and the preset segmentation function. As compared with the prior art in which the maximum grayscales of the white sub-pixels in the respective pixel elements is determined using a linear function, the problem that the maximum grayscales of the white sub-pixels in an area with higher brightness in the image is greater than the maximum grayscales of the white sub-pixels in an area with lower brightness in the image can be addressed to thereby improve the rendition and display effect of the image in color.

In a particular implementation, in some embodiments of the disclosure, after the maximum grayscales of the white sub-pixels in the respective pixel elements is determined, the method can further include:

displaying an image according to the determined maximum grayscales of the white sub-pixels in the respective pixel elements, and the grayscales corresponding to the red sub-pixels, the green sub-pixels, and the blue sub-pixels in the respective pixel elements.

Figure 6:
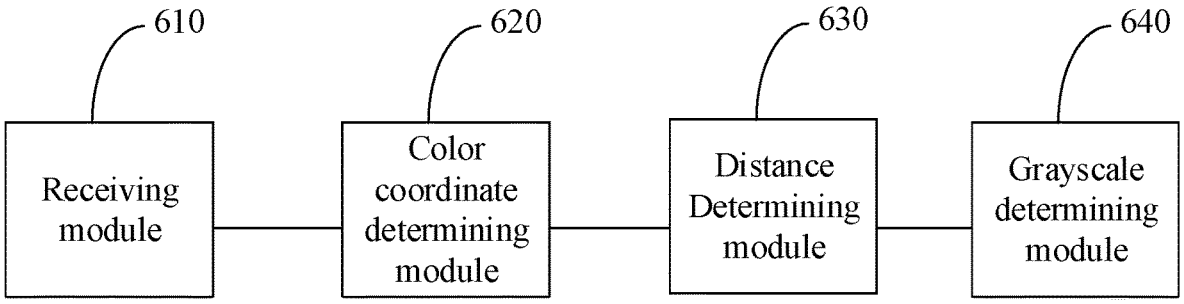
FIG. 6 is a schematic structural diagram of an apparatus for converting a grayscale according to some embodiments of the disclosure.

Based upon the same inventive idea, some embodiments of the disclosure further provides an apparatus for converting a grayscale as illustrated in FIG. 6, where the apparatus can include:

a receiving module 610 is configured to receive image data of a frame to be displayed, where the image data of the frame to be displayed can include grayscales corresponding respectively to red sub-pixels, green sub-pixels, and blue sub-pixels in respective pixel elements;

a color coordinate determining module 620 is configured to determine color coordinates of the respective pixel elements according to the grayscales corresponding to the red sub-pixels, the green sub-pixels, and the blue sub-pixels in the respective pixel elements;

a distance determining module 630 is configured to determine the distances between the color coordinates of the respective pixel elements, and color coordinates of a preset white pixel on the panel, in a CIE chroma graph; and a grayscale determining module 640 is configured to determine the maximum grayscales of the white sub-pixels in the respective pixel elements according to the respective determined distances and a preset segmentation function.

In a particular implementation, in some embodiments of the disclosure, the grayscale determining module is configured, for each pixel element, to determine the maximum grayscale $W_{pixel_max}$ of the white sub-pixel in the pixel element in the equation of:

$$W_{pixel_max} = f(k) * W_{max}, \text{ and}$$

$$f(k) = \begin{cases} \alpha_0 + \alpha_1 k + \alpha_2 k^2 + \alpha_3 k^3 + \ldots + \alpha_n k^n & (0 \le k \le k_1) \\ \beta_0 + \beta_1 k + \beta_2 k^2 + \beta_3 k^3 + \ldots + \beta_m k^m & (k_1 < k \le 1) \end{cases},$$

where k represents the distance between the color coordinates of the pixel element, and the color coordinates of the preset white pixel on the panel, in the CIE chroma graph, $W_{max}$ represents the maximum of all the normalized grayscales in the image data of the frame to be displayed, $\alpha_n$ and $\beta_m$ represents coefficients respectively, $n \geq 0$ and n is an integer, $m \geq 0$ and m is an integer, and $0 \leq k_1 \leq 1$.

In a particular implementation, in some embodiments of the disclosure, $\alpha_n$, $\beta_m$, n, and m can be empirically derived respectively, or can be determined respectively as needed in a real application environment. For example, the really fabricated display panel can be tested so that $k_1=0.5$, n=3, m=2, $\alpha_1=_1$, $\alpha_2=-3.422$, $\alpha_3=8.6209$, $\alpha_4=-7.5536$, $\beta_1=-0.2451$, $\beta_2=2.7085$, $\beta_3=-2.4617$ are derived from test results through fitting, that is, $$f(k) = \begin{cases} 1 - 3.422k + 8.6209k^2 - 7.5536k^3 & (0 \leq k \leq 0.5) \\ -0.2451 + 2.7085k - 2.4617k^2 & (0.5 < k \leq 1) \end{cases},$$

thus providing the best display effect of the display panel.

In a particular implementation, in some embodiments of the disclosure, the color coordinate determining module is configured, for each pixel element, to determine a simulation value X corresponding to the red sub-pixel, a simulation value Y corresponding to the green sub-pixel, and a simulation value Z corresponding to the blue sub-pixel in the pixel element in the equation of:

$$\begin{pmatrix} X \\ Y \\ Z \end{pmatrix} = \begin{pmatrix} X_R & X_G & X_B \\ Y_R & Y_G & Y_B \\ Z_R & Y_G & Z_B \end{pmatrix} * \begin{pmatrix} R \\ G \\ B \end{pmatrix},$$

where $$\begin{pmatrix} X_R & X_G & X_B \\ Y_R & Y_G & Y_B \\ Z_R & Y_G & Z_B \end{pmatrix}$$

represents coefficients, R represents the grayscale of the red sub-pixel in the pixel element, G represents the grayscale of the green sub-pixel in the pixel element, and B represents the grayscale of the blue sub-pixel in the pixel element; and to determine the color coordinates (x, y) of the pixel element according to the determined simulation value X corresponding to the red sub-pixel, simulation value Y corresponding to the green sub-pixel, and the simulation value Z corresponding to the blue sub-pixel in the equation of:

$$\begin{cases} x = \dfrac{X}{X+Y+Z} \\ y = \dfrac{Y}{X+Y+Z} \end{cases}.$$

Those skilled in the art shall appreciate that the embodiments of the disclosure can be provided as a method, a system, or a computer program product, so the disclosure can be embodied in the form of an all-hardware embodiment, an all-software embodiment, or an embodiment of a combination of software and hardware. Furthermore the disclosure can be embodied in the form of a computer program product embodied in one or more computer readable storage mediums (including but not limited to a disk memory, an optical memory, etc.) including computer readable program codes.

Based upon the same inventive idea, some embodiments of the disclosure further provide a display device including the apparatus for converting a grayscale according to any one of the embodiments above of the disclosure. The display device addresses the problem under a similar principle to the apparatus above for converting a grayscale, so reference can be made to the apparatus above for converting a grayscale for an implementation of the display device, and a repeated description thereof will be omitted here.

In a particular implementation, the display device according to some embodiments of the disclosure can further include a display panel and a display driver, where as illustrated in FIG. 1, the display panel includes a plurality of pixel elements PX, each of which includes a red sub-pixel R, a green sub-pixel G, a blue sub-pixel B, and a white sub-pixel W. Furthermore the display driver is configured to drive the display panel to display an image, according to the maximum grayscales of the white sub-pixels in the respective pixel elements, and the grayscales corresponding to the red sub-pixels, the green sub-pixels, and the blue sub-pixels in the respective pixel elements, determined by the apparatus for converting a grayscale. Furthermore those skilled in the art shall appreciate that the display driver can be embodied in the form of an embodiment of a combination of software and hardware.

In a particular implementation, the display device according to some embodiments of the disclosure can be a mobile phone, a tablet computer, a TV set, a monitor, a notebook computer, a digital photo frame, a navigator, or any other product or component with a display function. All the other components indispensable to the display device shall readily occur to those ordinarily skilled in the art, so a repeated description thereof will be omitted here.

In the method and apparatus for converting a grayscale, and the display device according to embodiments of the disclosure, the color coordinates of the respective pixel elements are determined according to the grayscales corresponding to the red sub-pixels, the green sub-pixels, and the blue sub-pixels in the respective pixel elements in the image data of the frame to be displayed, and then the distances between the color coordinates of the respective pixel elements, and the color coordinates of the preset white pixel on the panel, in the CIE chroma graph are determined; and the maximum grayscales of the white sub-pixels in the respective pixel elements is further determined according to the respective determined distances and the preset segmentation function. As compared with the prior art in which the maximum grayscales of the white sub-pixels in the respective pixel elements is determined using a linear function, the problem that the maximum grayscales of the white sub-pixels in an area with higher brightness in the image is more than the maximum grayscales of the white sub-pixels in an area with lower brightness in the image can be addressed to thereby improve the rendition and display effect of the image in color.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A method for converting a grayscale, the method comprising:

receiving image data of a frame to be displayed, wherein the image data of the frame to be displayed comprise grayscales corresponding respectively to red sub-pixels, green sub-pixels, and blue sub-pixels in respective pixel elements;

determining color coordinates of the respective pixel elements according to the grayscales corresponding to the red sub-pixels, the green sub-pixels, and the blue sub-pixels in the respective pixel elements;

determining distances between the color coordinates of the respective pixel elements and color coordinates of a preset white pixel on a panel, in a CIE chroma graph; and determining a maximum grayscale of the white sub-pixels in the respective pixel elements according to respective determined distances and a preset segmentation function;

wherein the determining the maximum grayscale of the white sub-pixels in the respective pixel elements according to the respective determined distances and the preset segmentation function comprises:

for each pixel element, determining the maximum grayscale $W_{pixel_max}$ of the white sub-pixel in the pixel element in the equation of:

$$W_{pixel_max} = f(k) * W_{max}, \text{ and}$$

$$f(k) = \begin{cases} \alpha_0 + \alpha_1 k + \alpha_2 k^2 + \alpha_3 k^2 + \ldots + \alpha_n k^n & (0 \le k \le k_1) \\ \beta_0 + \beta_1 k + \beta_2 k^2 + \beta_3 k^3 + \ldots + \beta_m k^m & (k_1 < k \le 1) \end{cases},$$

wherein k represents the distance between the color coordinates of the pixel element, and the color coordinates of the preset white pixel on the panel, in the CIE chroma graph, $W_{max}$ represents a maximum of all normalized grayscales in the image data of the frame to be displayed, $\alpha_n$ and $\beta_m$ represents coefficients respectively, $n \ge 0$ and n is an integer, $m \ge 0$ and m is an integer, and $0 \le k_1 \le 1$.

2. The method for converting a grayscale according to claim 1, wherein $k_1=0.5$, n=3, and m=2.

3. The method for converting a grayscale according to claim 1, wherein the determining the color coordinates of the respective pixel elements according to the grayscales corresponding to the red sub-pixels, the green sub-pixels, and the blue sub-pixels in the respective pixel elements comprises:

for each pixel element, determining a simulation value X corresponding to the red sub-pixel, a simulation value Y corresponding to the green sub-pixel, and a simulation. value Z corresponding to the blue sub-pixel in the pixel element in the equation of:

$$\begin{pmatrix} X \\ Y \\ Z \end{pmatrix} = \begin{pmatrix} X_R & X_G & X_B \\ Y_R & Y_G & Y_B \\ Z_R & Y_G & Z_B \end{pmatrix} * \begin{pmatrix} R \\ G \\ B \end{pmatrix},$$

wherein $$\begin{pmatrix} X_R & X_G & X_B \\ Y_R & Y_G & Y_B \\ Z_R & Y_G & Z_B \end{pmatrix}$$

represents coefficients, R represents the grayscale of the red sub-pixel in the pixel element, Ci represents the grayscale of the green sub-pixel in the pixel element, and B represents the gmyscale of the blue sub-pixel in the pixel element; and determining the color coordinates (x, y) of the pixel element according to determined simulation value X corresponding to the red sub-pixel, simulation value corresponding to the green sub-pixel, and the simulation value Z corresponding to the blue sub-pixel in the equation of:

$$\begin{cases} x = \dfrac{X}{X+Y+Z} \\ y = \dfrac{Y}{X+Y+Z} \end{cases}.$$

4. An apparatus for converting a grayscale, the apparatus comprising:

a receiving module configured to receive image data of a frame to be displayed, wherein the image data of the frame to be displayed comprise grayscales corresponding respectively to red sub-pixels, green sub-pixels, and blue sub-pixels in respective pixel elements;

a color coordinate determining module configured to determine color coordinates of the respective pixel elements according to the grayscales corresponding to the red sub-pixels, the green sub-pixels, and the blue sub-pixels in the respective pixel elements;

a distance determining module configured to determine distances between the color coordinates of the respective pixel elements and color coordinates of a preset white pixel on the panel, in a CIE chroma graph; and a grayscale determining module configured to determine a maximum grayscale of the white sub-pixels in the respective pixel elements according to the respective determined distances and a preset segmentation function;

wherein the grayscale determining module is configured, for each pixel element, to determine the maximum grayscale $W_{pixel_max}$ of the white sub-pixel in the pixel element in the equation of:

$$W_{pixel_max} = f(k) * W_{max}, \text{ and}$$

$$f(k) = \begin{cases} \alpha_0 + \alpha_1 k + \alpha_2 k^2 + \alpha_3 k^2 + \ldots + \alpha_n k^n & (0 \le k \le k_1) \\ \beta_0 + \beta_1 k + \beta_2 k^2 + \beta_3 k^3 + \ldots + \beta_m k^m & (k_1 < k \le 1) \end{cases},$$

wherein k represents the distance between the color coordinates of the pixel element, and the color coordinates of the preset white pixel on the panel, in the CIE chroma graph, $W_{max}$ represents the maximum of all the normalized grayscales in the image data of the frame to be displayed, $\alpha_n$ and $\beta_m$ represents coefficients respectively, $n \ge 0$ and n is an integer, $m \ge 0$ and m is an integer, and, $0 \le k_1 \le 1$.

5. The apparatus for converting a grayscale according to claim 4, wherein $k_1=0.5$, n=3, and m=2.

6. The apparatus for converting a grayscale according to claim 4, wherein the color coordinate determining module is configured, for each pixel element, to determine a simulation value X corresponding to the red sub-pixel, a simulation. value Y corresponding to the green sub-pixel, and a simulation value Z corresponding to the blue sub-pixel in the pixel. element in the equation of:

$$\begin{pmatrix} X \\ Y \\ Z \end{pmatrix} = \begin{pmatrix} X_R & X_G & X_B \\ Y_R & Y_G & Y_B \\ Z_R & Y_G & Z_B \end{pmatrix} * \begin{pmatrix} R \\ G \\ B \end{pmatrix},$$

wherein $$\begin{pmatrix} X_R & X_G & X_B \\ Y_R & Y_G & Y_B \\ Z_R & Y_G & Z_B \end{pmatrix}$$

represents coefficients, R represents the grayscale of the red sub-pixel in the pixel element, G represents the grayscale of the green sub-pixel in the pixel element, and B represents the grayscale of the blue sub-pixel in the pixel element; and to determine the color coordinates (x, y) of the pixel element according to determined simulation value X corresponding to the red sub-pixel, simulation value Y corresponding to the green sub-pixel, and the simulation value Z corresponding to the blue sub-pixel in the equation of:

$$\begin{cases} x = \dfrac{X}{X+Y+Z} \\ y = \dfrac{Y}{X+Y+Z} \end{cases}.$$

7. A display device, comprising the apparatus for converting a grayscale according to claim 4.

8. The display device according to claim 7, wherein $k_1$=0.5, n=3, and m=2.

9. The display device according to claim 7, wherein the color coordinate determining module is configured, for each pixel element, to determine a simulation value X corresponding to the red sub-pixel, a simulation value Y corresponding to the green sub-pixel, and a simulation value Z. corresponding to the blue sub-pixel in the pixel element in the equation of:

$$\begin{pmatrix} X \\ Y \\ Z \end{pmatrix} = \begin{pmatrix} X_R & X_G & X_B \\ Y_R & Y_G & Y_B \\ Z_R & Y_G & Z_B \end{pmatrix} * \begin{pmatrix} R \\ G \\ B \end{pmatrix},$$

wherein $$\begin{pmatrix} X_R & X_G & X_B \\ Y_R & Y_G & Y_B \\ Z_R & Y_G & Z_B \end{pmatrix}$$

represents coefficients, R represents the grayscale of the red sub-pixel in the pixel element, G represents the grayscale of the green sub-pixel in the pixel element, and B represents the grayscale of the blue sub-pixel in the pixel element; and to determine the color coordinates (x, y) of the pixel element according to determined simulation value X corresponding to the red sub-pixel, simulation value Y corresponding to the green sub-pixel, and the simulation value Z corresponding to the blue sub-pixel in the equation of:

$$\begin{cases} x = \dfrac{X}{X+Y+Z} \\ y = \dfrac{Y}{X+Y+Z} \end{cases}.$$

10. The display device according to claim 7, wherein the display device further comprises a display panel and a display driver, wherein the display panel comprises a plurality of pixel elements PX, each of which comprises a red sub-pixel R, a green sub-pixel G, a blue sub-pixel B, and a white sub-pixel W; and the display driver is configured to drive the display panel to display an image, according to the maximum grayscales of the white sub-pixels in. the respective pixel elements, and the grayscales corresponding to the red sub-pixels, the green sub-pixels, and the blue sub-pixels in the respective pixel elements, determined by the apparatus for converting a grayscale.

* * * * *